US007243884B2

(12) United States Patent
Lawson et al.

(10) Patent No.: US 7,243,884 B2
(45) Date of Patent: Jul. 17, 2007

(54) TILT-OUT LAUNDRY BAG ASSEMBLY

(76) Inventors: Stephen Lawson, 1947 Ocean Park Road, Surrey, B.C. (CA) V4A 3M2; Christopher Isfeld, 30681 Regal Parkway, Abbotsford, B.C. (CA) V3G 1L1

( * ) Notice: Subject to any disclaimer, the term of this patent is extended or adjusted under 35 U.S.C. 154(b) by 423 days.

(21) Appl. No.: 11/036,854

(22) Filed: Jan. 18, 2005

(65) Prior Publication Data

US 2006/0175474 A1 Aug. 10, 2006

(51) Int. Cl.
*B65B 67/12* (2006.01)

(52) U.S. Cl. ..... 248/95; 248/99; 248/97; 248/100; 211/12; 211/85.15; 383/22; 383/23; 383/33

(58) Field of Classification Search ..... 248/99, 248/95, 97, 100; 211/12, 85.15; 383/22, 383/23, 33; 229/67.2
See application file for complete search history.

(56) References Cited

U.S. PATENT DOCUMENTS 447,686 A * 3/1891 Holladay ..... 248/97
2,645,541 A * 7/1953 Mintz et al. ..... 312/6
3,175,793 A * 3/1965 Kennedy ..... 248/99
3,339,823 A * 9/1967 Bessermann-Nielsen ..... 383/15
3,603,542 A * 9/1971 Grille ..... 248/98
3,630,251 A * 12/1971 Ross ..... 220/751
3,870,261 A * 3/1975 McSwain ..... 248/101
3,980,360 A * 9/1976 Wright et al. ..... 312/184
4,445,658 A * 5/1984 Ferron ..... 248/99
4,458,867 A * 7/1984 Malik ..... 248/97
4,487,388 A * 12/1984 Provan ..... 248/97
4,664,455 A * 5/1987 Greenhow ..... 312/211
4,762,297 A * 8/1988 Milligan ..... 248/99
4,979,705 A * 12/1990 Bovitz ..... 248/97
5,125,517 A * 6/1992 Martinell ..... 211/18
5,190,253 A * 3/1993 Sable ..... 248/97
5,350,142 A * 9/1994 Kurtzman et al. ..... 248/99
5,373,951 A * 12/1994 Arnold ..... 211/106
5,551,654 A * 9/1996 McNerney ..... 248/99
5,628,439 A * 5/1997 O'Hara ..... 224/275
5,667,066 A 9/1997 Simpson
6,062,416 A * 5/2000 Smillie ..... 220/524
6,302,281 B1 * 10/2001 Wang ..... 211/118
6,382,573 B1 * 5/2002 Cepeda ..... 248/97
RE37,924 E * 12/2002 Kellogg et al. ..... 220/9.2
6,637,938 B2 10/2003 Watkins
6,659,273 B1 * 12/2003 Scola ..... 206/285
6,976,786 B1 * 12/2005 Stanley, Jr. ..... 383/25
2003/0057171 A1 * 3/2003 Wang ..... 211/195
2006/0157358 A1 * 7/2006 Heidel ..... 206/278

* cited by examiner

*Primary Examiner*—Anita King
*Assistant Examiner*—Michael McDuffie
(74) *Attorney, Agent, or Firm*—Frederick Kaufman Inc.

(57) ABSTRACT

A tilt-out laundry bag assembly for use with a bottom hinged cabinet door, comprises a suspension bracket subassembly and a laundry bag subassembly, the latter being suspended from the former. The suspension bracket subassembly includes a pair of parallel inter-bracket rods located in a plane perpendicular to the bottom hinged cabinet door. One of the rods is spaced from the mentioned door, while a second one is located in a position somewhat retracted from that door. The laundry bag subassembly comprises at least one laundry bag and a pair of hangers for each laundry bag. A laundry bag includes a pair of opposite flat panels and a pair of opposite folded panels. Each of the former has at the top a pair of loops for each hanger. Each hanger has a central grip for a hand and at each extremity a semi-circular configuration to fit with each one of the inter-bracket rods.

4 Claims, 3 Drawing Sheets

TILT-OUT LAUNDRY BAG ASSEMBLY

BACKGROUND OF THE INVENTION

1. Field of the Invention

The present invention relates in general to the storage of laundry bags in recessed spaces. More specifically, it relates to a tilt-out laundry bag assembly adapted to be used in conjunction with a bottom hinged cabinet door.

2. Description of the Prior Art

Generally, laundry bags have been used to store soiled and dirty clothing until it is washed and dried.

One of the outstanding problems in the field of laundry bags resides in the difficulty of keeping them and their stands out of sight.

Attempts have been made in the past by the applicants of the present invention to judiciously use the confined spaces, available in closet receptacles, in order to keep the laundry bags and their stands out of sight in a functional and stylish manner. Thus, a patent application entitled "COMBINATION OF A TELESCOPICALLY EXTENDABLE FRAME WITH A LAUNDRY BAG ASSEMBLY", adaptable to be mounted in closet receptacles of various articles of furniture, has been filed by the applicants of the present application and is copending with it. The previously filed application is neither designed nor adaptable for use in a recessed space closed by a tilt-out door of a cabinet. UK Patent Application GB No. 2 401 776 published on Nov. 24, 2004 and entitled "LAUNDRY CABINET WITH TILTING DOOR AND FOLDING CONTAINER FRAME" refers to an assembly that is used with a door that is hinged at its bottom edge and opens outward of a cabinet structure to provide access to a bag; the door retracts by gravitation. A bag made of fabric is releasable attached via pop fasteners to a foldable metal frame that holds the bag open. The foldable metal frame is secured to the door via clips and screws. There are several disadvantages to the foregoing design. First, the metal frame is folded only once for shipping and therefore the use of a foldable frame is not fully justified or at least is questionable, especially when stackable designs for easy shipping are known. Second, the attachment of the bag to the foldable metal frame via pop fasteners does not allow a fast and easy detachment from that frame. Third, the bag is not provided with means for grasping and transporting it to a laundry room or Laundromat. There are also known on the market tilt-out hampers using, generally, removable, plastic baskets. Among the companies that supply this type of hampers are KU STORE HOME PRODUCTS, EVERYTHING FURNITURE, COMFORT HOUSE and REAL SOLUTIONS.

SUMMARY OF THE INVENTION

The applicants believe that is desirable to have a tilt-out laundry bag assembly that is adapted to be attached to a bottom hinged cabinet door and allows to open the door and access a laundry basket in one easy motion.

Thus, it is a first objective of the present invention to design a suspension bracket subassembly that is stackable and, hence, convenient for shipping.

It is another objective of this invention to provide a tilt-out laundry bag subassembly that can be easily disengaged from the laundry bag subassembly and carried to a laundry room.

Broadly described, a tilt-out laundry bag assembly, adaptable a to be used in conjunction with a bottom hinged cabinet door, comprises in combination a suspension bracket subassembly and a laundry bag subassembly, the latter being conveniently suspended from the former, The suspension bracket subassembly includes a pair of spaced inter-bracket tie rods located in a common plane perpendicular to the bottom hinged cabinet, a first one of the pair of spaced inter-bracket tie rods being spaced from the bottom hinged cabinet, while a second one is located in a position somewhat retracted from the bottom hinged cabinet.

The laundry bag subassembly comprises at least one laundry bag and a pair of hangers for each laundry bag that includes, when collapsed, a pair of opposite flat panels; and a pair of opposite folded panels, each one of the pair of opposite flat panels is provided at its top with a pair of loops for one of the pair of hangers; each one of the pair of hangers is provided with a central grip portion for an user's hand and at each extremity with a semi-circular configuration for self-aligning with a sliding fit on each one of the pair of spaced inter-bracket tie rods.

More specifically, the tilt-out laundry bag assembly according to the present invention is adaptable to be used in conjunction with a bottom hinged cabinet door. The tilt-out laundry bag assembly comprises, in combination, a suspension bracket subassembly and a laundry bag subassembly, the latter being conveniently suspended from the former.

The suspension bracket subassembly includes, in a first embodiment a pair of spaced, parallel brackets;

a pair of spaced inter-bracket tie rods perpendicular to the pair of spaced, parallel brackets and situated in a common plane; and a upper brace rod parallel to the pair of spaced inter-bracket tie rods and located in a plane above the mentioned common plane.

Each one of the pair of spaced, parallel brackets is adaptable for mount in a vertical position to the bottom hinged cabinet door, the latter being conventionally considered in a closed position, and is formed from an upper segment and a lower segment diverging from a common point at an acute angle. The upper segment is perpendicularly disposed with respect to the bottom hinged cabinet door and extends into an upper tie rod. An angle of 90° is formed between each upper segment and each upper tie rod. The latter incorporates a hole-provided flat zone. The lower segment extends into a lower tie rod, an obtuse angle being formed between each lower segment and each lower tie rod. The latter also incorporates a hole-provided flat zone; both hole-provided flat zones of the upper and lower tie rods are coplanar.

The pair of spaced inter-bracket tie rods and the upper segments are coplanar and interconnect. The pair of spaced inter-bracket tie rods is disposed as follows: a first one is located proximate to the common point of the acute angle, while a second one is located in a position somewhat retracted from the bottom hinged cabinet door.

The upper brace rod is situated in the same plane with the upper tie rods and is perpendicular to the latter, being used to connect its ends.

For load transfer of the tilt-out laundry bag assembly to the bottom hinged cabinet door, the former is attached to the latter with securing means inserted through the hole-provided flat zones.

The laundry bag subassembly comprises at least one laundry bag and a pair of hangers for each laundry bag. The latter includes, when collapsed, a pair of opposite flat panels;

a pair of opposite folded panels, generally extendable inwardly between the pair of opposite flat panels; and a closed bottom.

Each one of the pair of opposite flat panels is provided with a pair of loops secured adjacent an open top of the laundry bag.

Each one of the pair of hangers has in general a rod structure with a generally elongated profile and is provided with a central grip portion, adaptable to accommodate a user's hand. The central grip portion, being spaced upwardly from a remainder part of the hanger, does not interfere with the loops. The central grip portion being vertically oriented, the carrying of the laundry bag can be comfortably accomplished in one hand. Each hanger terminates at each end with a semi-circular configuration, so dimensioned as to self-align with a sliding fit on the pair of spaced inter-bracket tie rods; the semi-circular configurations are open downwardly. The hanger is easily inserted through the loops of each one of the pair of opposite flat panels, so that the central grip portion is situated between the loops. Removal of a hanger from the loops is obviously, as easy as the insertion into the latter.

A distance between geometrical centers of the semi-circular configurations of the hanger is commensurable with a distance between longitudinal geometrical axes of the pair of spaced inter-bracket tie rods.

More specifically, the tilt-out laundry bag assembly according to the present invention comprises in combination a suspension bracket subassembly and a laundry bag subassembly, the latter being conveniently suspended from the former.

The suspension bracket subassembly includes in a second embodiment a pair of spaced inter-bracket tie rods, one of the latter being spaced from and parallel to said bottom hinged cabinet door and extending, at is extremities, into a pair of upper segments;

another one of said pair of inter-bracket tie rods being parallel and coplanar with the previous one and being somewhat retracted from said bottom hinged cabinet door serves as well for joining said pair of upper segments, said pair of upper segments being perpendicular to said pair of inter-bracket tie rods and to said bottom hinged cabinet door and extending into a pair of lower tie rods, an angle of 90° being formed between each said upper segment and each said lower tie rod, after which said pair of lower tie rods extends into a pair of lower segments and an acute angle is formed between each said lower tie rod and each said lower segment, each said lower segment ending adjacent each junction between said inter-bracket tie rod, which is spaced from said bottom hinged cabinet and each said upper segment and is connected beneath the latter; and each said lower tie rod incorporates a pair of spaced hole-provided flat zones for use with screws or alike;

More specifically, the tilt-out laundry bag assembly according to the present invention is adaptable to be used in conjunction with a bottom hinged cabinet door. The tilt-out laundry bag assembly comprises, in combination, a suspension bracket subassembly and a laundry bag subassembly, the latter being conveniently suspended from the former.

The suspension bracket subassembly includes, in a second embodiment a pair of spaced inter-bracket tie rods, one of the latter being spaced from and parallel to the bottom hinged cabinet door and extending, at is extremities, into a pair of upper segments;

another one of the pair of inter-bracket tie rods is parallel and coplanar with the previous one and is somewhat retracted from the bottom hinged cabinet door, serving as well for joining the pair of upper segments. The latter is perpendicular to the pair of inter-bracket tie rods and to the bottom hinged cabinet door and extends into a pair of lower tie rods. An angle of 90° is formed between each upper segment and each lower tie rod, after which the pair of lower tie rods extends into a pair of lower segments. An acute angle is formed between each lower tie rod and each lower segment. Each lower segment ends adjacent each junction between the inter-bracket tie rod, which is spaced from the bottom hinged cabinet and each upper segment and is connected beneath the latter. Each lower tie rod incorporates a pair of spaced hole-provided flat zones for use with screws or alike.

The laundry bag subassembly comprises at least one laundry bag and a pair of hangers for each laundry bag. The latter includes, when collapsed, a pair of opposite flat panels;

a pair of opposite folded panels, generally extendable inwardly between the pair of opposite flat panels; and a closed bottom.

Each one of the pair of opposite flat panels is provided with a pair of loops secured adjacent an open top of the laundry bag.

Each one of the pair of hangers has in general a rod structure with a generally elongated profile and is provided with a central grip portion, adaptable to accommodate a user's hand. The central grip portion, being spaced upwardly from a remainder part of the hanger, does not interfere with the loops. The central grip portion being vertically oriented, the carrying of the laundry bag can be comfortably accomplished in one hand. Each hanger terminates at each end with a semi-circular configuration, so dimensioned as to self-align with a sliding fit on the pair of spaced inter-bracket tie rods; the semi-circular configurations are open downwardly. The hanger is easily inserted through the loops of each one of the pair of opposite flat panels, so that the central grip portion is situated between the loops. Removal of a hanger from the loops is obviously, as easy as the insertion into the latter.

A distance between geometrical centers of the semi-circular configurations of the hanger is commensurable with a distance between longitudinal geometrical axes of the pair of spaced inter-bracket tie rods.

In one aspect, common to the two embodiments, holding clamps using screw fasteners are substituted for hole-provided flat zones.

BRIEF DESCRIPTION OF THE DRAWINGS

Although the characteristic features of the invention will be particularly pointed out in the claims, the invention itself and the manner in which it may be made and used may be better understood by referring to the following description and accompanying drawings. Like reference numerals refer to like parts throughout the several views of the drawings in which:

DESCRIPTION OF THE PREFERRED EMBODIMENTS

Figure 1:
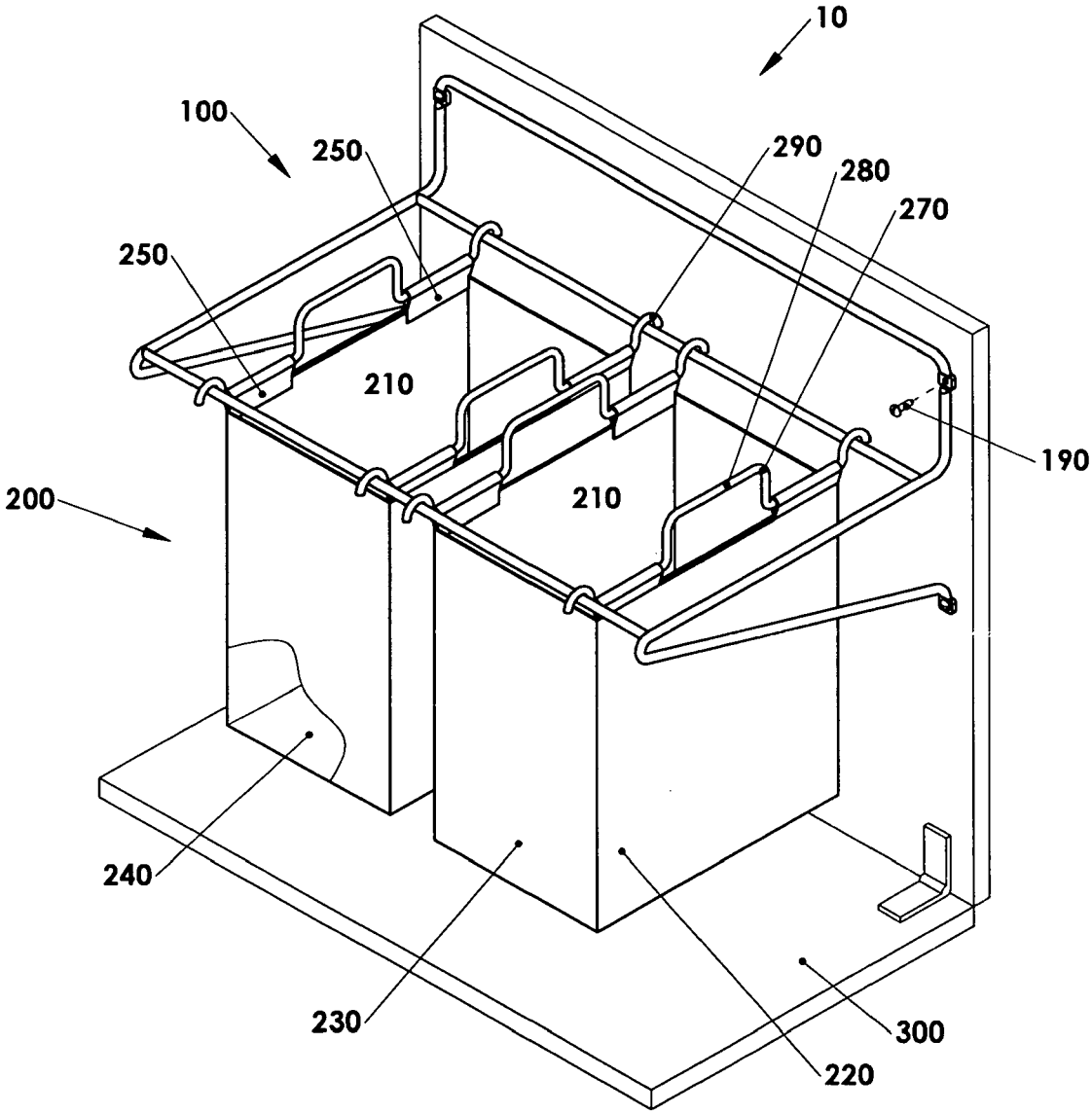
FIG. 1 is a perspective view of a door-mounted tilt-out laundry bag assembly.

The tilt-out laundry bag assembly of this invention is generally indicated at 10 in FIG. 1, wherein a suspension bracket subassembly is generally indicated at 100 and a laundry bag subassembly is generally indicated at 200, the latter being conveniently suspended from the former.

Referring again to FIG. 1, it will be seen that the present invention is used in conjunction with a bottom hinged cabinet door, indicated at 300.

Figure 2:
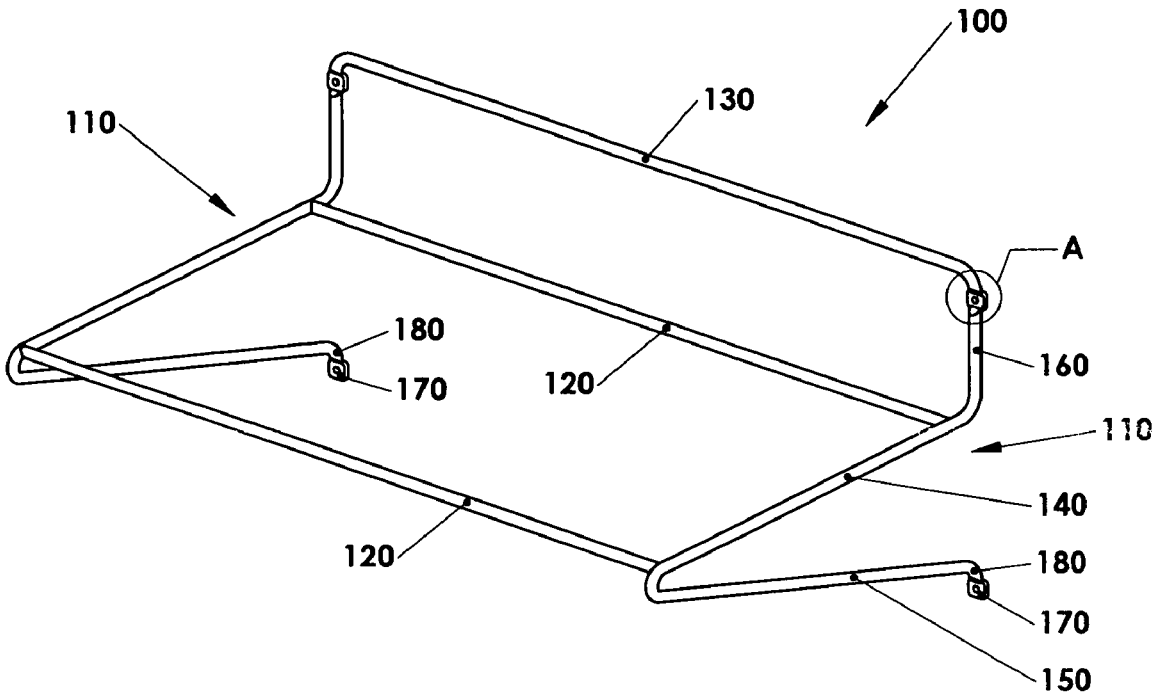
FIG. 2 is a perspective view of a suspension bracket subassembly described in a first embodiment.

In a first embodiment, (see FIGS. 1 and 2), suspension bracket subassembly 100 constitutes a unitary, continuous-rod structure comprising a pair of spaced, parallel brackets 110, a pair of spaced inter-bracket tie rods 120, both perpendicular to the latter and both situated in a common plane, and an upper brace rod 130, parallel to the pair of spaced inter-bracket tie rods 120 and located in a plane above the mentioned common plane.

Figure 3:
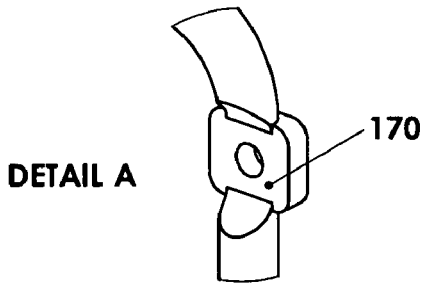
FIG. 3 is an enlarged view of a hole-provided flat zone as seen in A of FIG. 2.

Each one of the pair of spaced, parallel brackets 110 is adaptable for mount in a vertical position to bottom hinged cabinet door 300, the latter being conventionally considered in a closed position, and is formed from an upper segment 140 and a lower segment 150 diverging from a common point at an acute angle. Upper segment 140 that is perpendicular to bottom hinged cabinet door 300, extends into an upper tie rod 160. An angle of 90° is formed between each upper segment 140 and each upper tie rod 160. The latter incorporates a hole-provided flat zone 170 (see FIG. 3). Lower segment 150 extends into a lower tie rod 180. An obtuse angle is formed between each lower segment 150 and each lower tie rod 180. The latter also incorporates a hole-provided flat zone 170. Hole-provided flat zones 170 of upper and lower tie rods 160 and 180 are coplanar.

The pair of spaced inter-bracket tie rods 120 and the upper segments 140 are coplanar, the former being used to interconnect with the latter. The pair of spaced inter-bracket tie rods 120 are placed as follows: a first one is located proximate to common point of the acute angle, while a second one is located in a position somewhat retracted from bottom hinged cabinet door 300.

Upper brace rod 130 is situated in the same plane with upper tie rods 160. Upper brace rod 130 is perpendicular to upper tie rod 160 and is used to connect the ends of the latter.

For load transfer of tilt-out laundry bag assembly 10 to bottom hinged cabinet door 300, the former is secured to the latter with self drilling wood screws 190 (see FIG. 1) inserted through hole-provided flat zones 170.

Figure 4:
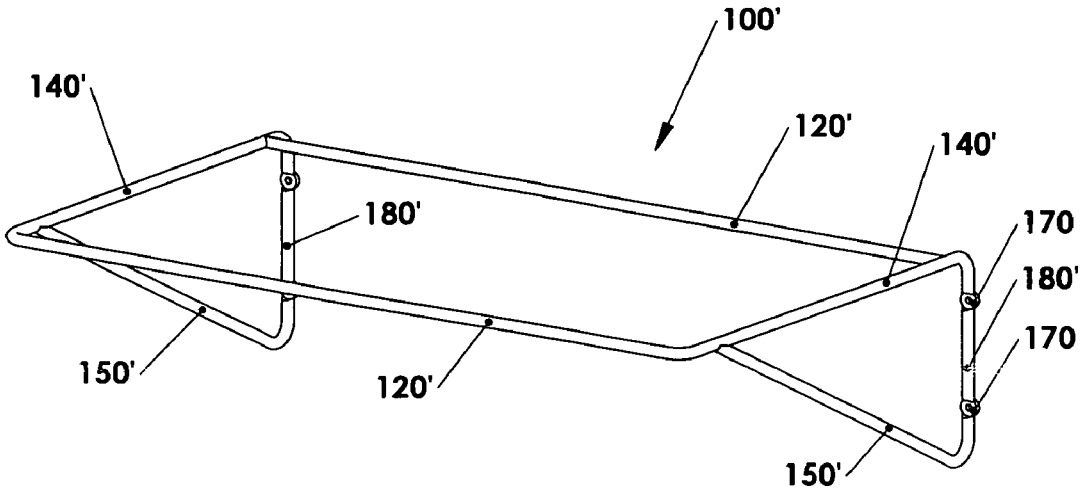
FIG. 4 is a perspective view of a suspension bracket subassembly described in a second embodiment.

In a second embodiment, (see FIG. 4), a suspension bracket assembly 100' constitutes as well a unitary, continuous-rod structure that incorporates a pair of spaced inter-bracket tie rods 120'.

One of the latter is spaced from and parallel to bottom hinged cabinet door 300 and extends, at is extremities, into a pair of upper segments 140'. Another one of the pair of inter-bracket tie rods 120' is parallel and coplanar with the previous one and is somewhat retracted from bottom hinged cabinet door 300 and serves as well to join the pair of upper segments 140'. The pair of upper segments 140' is perpendicular to the pair of inter-bracket tie rods 120' and to bottom hinged cabinet door 300, and extends into a pair of lower tie rods 180'. An angle of 90° is formed between each upper segment 140' and each lower tie rod 180'. Then, the pair of lower tie rods 180' extends into a pair of lower segments 150'. An acute angle is formed between each lower tie rod 180'and each lower segment 150'. Each lower segment 150'ends adjacent a junction between inter-bracket tie rod 120', which is spaced from bottom hinged cabinet door 300, and an upper segment 140' and is connected beneath the latter. Each lower tie rod 180' incorporates a pair of spaced hole-provided flat zones 170 for use with self drilling wood screws 190 (see FIG. 1).

Figure 5:
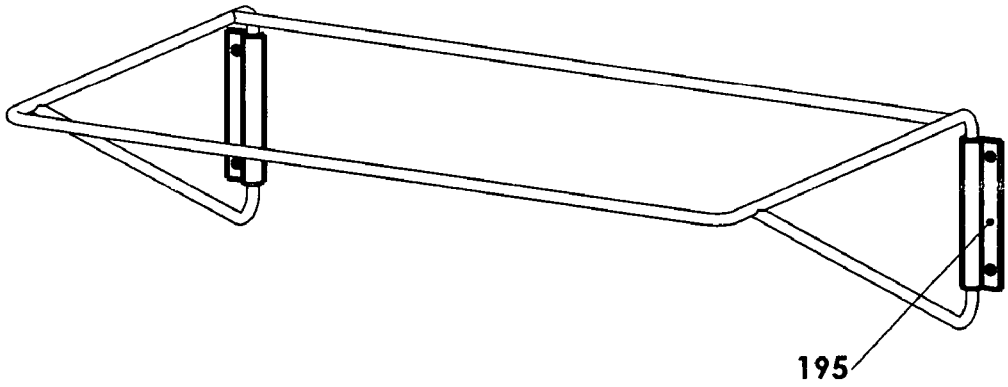
FIG. 5 is a perspective view of a suspension bracket subassembly described in the second embodiment, wherein holding clamps are used to substitute for hole-provided flat zones.

In a third embodiment, (see FIG. 5), a holding clamp 195, used for each lower tie rod 180', substitutes for hole-provided flat zones 170 disclosed in the previous embodiments. Obviously, fastening features, such as self drilling wood screws are used to attach each holding clamp 195 to bottom hinged cabinet door 300. Since holding clamps using wood screw fasteners are well known to those skilled in the art, further detailed description of this type of mechanical features is not deemed necessary.

Laundry bag subassembly 200 (see FIG. 1) is common for the foregoing embodiments and comprises one or more laundry bags 210 and a pair of grip and carry hangers, further called hangers 270, for each laundry bag 210. When more laundry bags 210 are used, this allows a sorting of the laundry to be washed, according to the type and color of the fabric.

Laundry bag 210 is made of washable fabric (conveniently to be washed together with the laundry) and includes, when collapsed, a pair of opposite flat panels 220 and a pair of opposite folded panels 230, generally extendable inwardly between the pair of opposite flat panels 220 from opposite side edges of the latter. Laundry bag 210, seen when unfolded, has a closed, flat bottom 240, usually formed from a single piece of fabric that is peripherally attached to lower ends of each pair of opposite flat and opposite folded panels 220 and 230, respectively.

As illustrated in FIG. 1, each one of the pair of opposite panels 220 is provided with a pair of spaced suspension loops 250, permanently secured, preferably by stitching, adjacent an open top. Each one of the pair spaced suspension loops 250, further called "loops 250", is made of flexible material, resistant to relative high tensions, and is adjacent to a proximate upper intersection between one of the pair of opposite flat panels 220 and an adjacent one of the pair of opposite folded panels 230. Loop 250 can also be formed by using a strap having one end portion firmly secured, adjacent the open top, to each one of the pair of opposite flat panels 220, and by doubling back and temporarily securing a second end portion to a remainder of the strap. To this end, use is made of removable attachments such as Velcro®, snap fasteners, buttons and buttonholes or alike. Loops 250 can also be made by folding portions of the upper margins of the pair of opposite panels 210 and then stitching to the latter.

As stated in the foregoing description, each laundry bag 210 is provided with a pair of hangers 270.

Each one of said pair of hangers 270 has a rod structure with a generally elongated profile, provided with a central grip portion 280, adaptable to accommodate a user's hand. Central grip portion 280 is spaced upwardly from the remainder part of hanger 270; hence it is situated above the latter (remainder part), and does not interfere with loops 250. Central grip portion 280 being vertically oriented, the carrying of laundry bag 210 can be comfortably accomplished in one hand. Each hanger 270 terminates at each end with a semi-circular configuration 290, so dimensioned as to self-align with a sliding fit on the pair of spaced inter-bracket tie rods 120 (first embodiment) and respectively 120' (second embodiment). Semi-circular configurations 290 are open downwardly. Hanger 270 can be easily inserted through loops 250 of each one of the pair of opposite flat panels 220, so that central grip portion 280 will be situated between loops 250. The removal of a hanger 270 from the loops 250 is, obviously, as easy as the insertion into the latter.

A distance between the geometrical centers of semicircular configurations 290 of a hanger 270 is commensurable with a distance between the longitudinal geometrical axes of the pair of spaced inter-bracket tie rods 120, respectively 120'.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as representative basis for teaching one skilled in the art to variously employ the present invention in virtually any appropriately detailed structure.

What we claim is:

1. A tilt-out laundry bag assembly, adaptable to be used in conjunction with a bottom hinged cabinet door, comprising in combination a suspension bracket subassembly and a laundry bag subassembly, the latter being conveniently suspended from the former, said suspension bracket subassembly including a pair of spaced, parallel brackets;

a pair of spaced inter-bracket tie rods perpendicular to said pair of spaced, parallel brackets and situated in a common plane; and an upper brace rod parallel to said pair of spaced inter-bracket tie rods and located in a plane above the mentioned common plane;

each one of said pair of spaced, parallel brackets being adaptable for mount in a vertical position to said bottom hinged cabinet door, the latter being conventionally considered in a closed position, and being formed from an upper segment and a lower segment diverging from a common point at an acute angle, said upper segment being perpendicularly disposed with respect to said bottom hinged cabinet door and extending into an upper tie rod, an angle of 90° being formed between each said upper segment and each said upper tie rod, the latter incorporating a hole-provided flat zone; said lower segment extending into a lower tie rod, an obtuse angle being formed between each said lower segment and each said lower tie rod, the latter also incorporating a zone such as said hole-provided flat zone, both said hole-provided flat zones of said upper and lower tie rods being coplanar;

said pair of spaced inter-bracket tie rods and said upper segments being coplanar are used to interconnect, said pair of spaced inter-bracket tie rods being placed as follows: a first one being located proximate to said common point of said acute angle, while a second one being located in a position somewhat retracted from said bottom hinged cabinet door;

said upper brace rod being situated in the same plane with said upper tie rods and said upper brace rod being perpendicular to said upper tie rod and being used to connect the ends of the latter; and for load transfer of said tilt-out laundry bag assembly to said bottom hinged cabinet door, the former is attached to the latter with securing means inserted through said hole-provided flat zones;

said laundry bag subassembly comprising at least one laundry bag and a pair of hangers for each said laundry bag that includes, when collapsed, a pair of opposite flat panels;

a pair of opposite folded panels, generally extendable inwardly between said pair of opposite flat panels; and a closed bottom;

each one of said pair of opposite flat panels being provided with a pair of loops secured adjacent an open top of said laundry bag;

each one of said pair of hangers generally having a rod structure with a generally elongated profile, provided with a central grip portion, adaptable to accommodate a user's hand, said central grip portion, being spaced upwardly from a remainder part of said hanger, does not interfere with said loops, said central grip portion being vertically oriented, the carrying of said laundry bag can be comfortably accomplished in one hand, each said hanger terminating at each end with a semi-circular configuration, so dimensioned as to self-align with a sliding fit on said pair of spaced inter-bracket tie rods, said semi-circular configurations being open downwardly;

said hanger being easily inserted through said loops of each one of said pair of opposite flat panels, so that said central grip portion is situated between said loops and a removal of a said hanger from said loops being obviously, as easy as the insertion into the latter; and a distance between geometrical centers of said semi-circular configurations of said hanger being commensurable with a distance between longitudinal geometrical axes of said pair of spaced inter-bracket tie rods.

2. A tilt-out laundry bag assembly, adaptable a to be used in conjunction with a bottom hinged cabinet door, comprising in combination a suspension bracket subassembly and a laundry bag subassembly, the latter being conveniently suspended from the former, said suspension bracket subassembly including a pair of spaced inter-bracket tie rods, one of the latter being spaced from and parallel to said bottom hinged cabinet door and extending, at is extremities, into a pair of upper segments;

another one of said pair of inter-bracket tie rods being parallel and coplanar with the previous one and being somewhat retracted from said bottom hinged cabinet door serves as well for joining said pair of upper segments, said pair of upper segments being perpendicular to said pair of inter-bracket tie rods and to said bottom hinged cabinet door and extending into a pair of lower tie rods, an angle of 90° being formed between each said upper segment and each said lower tie rod, after which said pair of lower tie rods extends into a pair of lower segments and an acute angle is formed between each said lower tie rod and each said lower segment, each said lower segment ending adjacent each junction between said inter-bracket tie rod, which is spaced from said bottom hinged cabinet and each said upper segment and is connected beneath the latter; and each said lower tie rod incorporates a pair of spaced hole-provided flat zones for use with screws or alike;

said laundry bag subassembly comprising at least one laundry bag and a pair of hangers for each said laundry bag that includes, when collapsed, a pair of opposite flat panels;

a pair of opposite folded panels, generally extendable inwardly between said pair of opposite flat panels; and a closed bottom;

each one of said pair of opposite flat panels being provided with a pair of loops secured adjacent an open top of said laundry bag;

each one of said pair of hangers generally having a rod structure with a generally elongated profile, provided with a central grip portion, adaptable to accommodate an user's hand, said central grip portion, being spaced upwardly from a remainder part of said hanger, does not interfere with said loops, said central grip portion being vertically oriented, the carrying of said laundry bag can be comfortably accomplished in one hand, each said hanger terminating at each end with a semi-circular configuration, so dimensioned as to self-align with a sliding fit on said pair of spaced inter-bracket tie rods, said semi-circular configurations being open downwardly;

said hanger being easily inserted through said loops of each one of said pair of opposite flat panels, so that said central grip portion it is situated between said loops and a removal of a said hanger from said loops being obviously, as easy as the insertion into the latter; and a distance between geometrical centers of said semi-circular configurations of said hanger being commensurable with a distance between longitudinal geometrical axes of said pair of spaced inter-bracket tie rods.

3. The tilt-out laundry bag assembly as defined in claim 1 or claim 2, wherein holding clamps using screw fasteners substitute for hole-provided flat zones.

4. A tilt-out laundry bag assembly, adaptable a to be used in conjunction with a bottom hinged cabinet door, comprising in combination a suspension bracket subassembly and a laundry bag subassembly, the latter being conveniently suspended from the former, said suspension bracket subassembly including a pair of spaced inter-bracket tie rods located in general in a common plane perpendicular to said bottom hinged cabinet, a first one of said pair of spaced inter-bracket tie rods being spaced from said bottom hinged cabinet, while a second one is located in a position somewhat retracted from said bottom hinged cabinet;

said laundry bag subassembly comprising at least one laundry bag and a pair of hangers for each said laundry bag that includes, when collapsed, a pair of opposite flat panels; and a pair of opposite folded panels, each one of said pair of opposite flat panels being provided at its top with a pair of loops for one of said pair of hangers, each one of said pair of hangers being provided with a central grip portion for a user's hand and at each extremity with a semi-circular configuration for self-aligning with a sliding fit on each one of said pair of spaced inter-bracket tie rods.

* * * * *